United States Patent [19]

Rogers et al.

[11] Patent Number: 4,854,077

[45] Date of Patent: Aug. 8, 1989

[54] FAIL-SAFE TIP-LOCK SHOE

[75] Inventors: Tracy G. Rogers, Rochester, N.Y.; Michael R. Nier, Harrisburg, Pa.; John Moran, Rochester, N.Y.

[73] Assignee: Schlegel Corporation, Rochester, N.Y.

[21] Appl. No.: 257,742

[22] Filed: Oct. 13, 1988

[51] Int. Cl.[4] ..... E05D 13/00; E05D 15/00

[52] U.S. Cl. ..... 49/322; 49/181

[58] Field of Search ..... 49/322, 181, 176, 161

[56] References Cited

U.S. PATENT DOCUMENTS

| | | | |
|---|---|---|---|
| 3,797,168 | 3/1974 | Trout | 49/181 |
| 4,068,406 | 1/1978 | Wood | 49/181 |
| 4,590,708 | 5/1986 | Campodonico | 49/181 |
| 4,696,375 | 9/1987 | Matthews et al. | 49/322 X |

*Primary Examiner*—Philip C. Kannan

*Attorney, Agent, or Firm*—Steele,Gould & Fried

[57] ABSTRACT

A tip-lock shoe for a window sash and the like, comprising: a hollow body adapted to slidably travel in a track; a locking member disposed in the body and movable between a retracted position enabling the body to slide freely in the track and an extended position for engaging the track and preventing movement of the body; a first lock activating member disposed in the body for engaging the window sash and for urging the locking member from the retracted position to the extended position responsive to tilting of the window sash and the like; and, a second lock activating member disposed in the body for engaging a counterbalance system for supporting the body in the track and for urging the locking member from the retracted position to the extended position independently of the first lock activating member and automatically responsive to a loss of counterbalance force, whereby the window sash and the like can be slidably and tiltably operated in normal fashion when the counterbalance system is operating properly but the window sash and the like is prevented from accidental movement when the counterbalance system fails. The second lock activating member preferably resiliently interconnects the counterbalance system and the hollow body, the second lock activating member being automatically urged into at least indirect engagement with the locking member upon failure of the counterbalance system.

20 Claims, 3 Drawing Sheets

FAIL-SAFE TIP-LOCK SHOE

BACKGROUND OF THE INVENTION

1. Field of the Invention

The invention relates generally to the field of slidably movable, track mounted panels and the like supported by counterbalance systems, and in particular, to a tip-lock shoe for window sashes and the like, which prevents such window sashes and the like from accidentally falling upon catastrophic failure of the counterbalance system.

2. Description of the Prior Art

Modern window assemblies are provided with means for enabling window sashes to be tilted into a room in order to facilitate installation, periodic cleaning and repair. Such window sashes are typically attached to shoes which are slidably mounted in vertically oriented tracks disposed on either side of the window frame. The shoes provide a point of interconnection between the window sash and the counterbalance system which enables the window sash to be easily raised and lowered, and which prevents the window sash from moving out of any opened or closed position in which it is placed. Such shoes are usually referred to as tip-lock shoes. Tip-lock shoes are provided with a braking mechanism by means of which the tip-lock shoe is locked into position into the track whenever the window sash is tilted out of a vertical orientation. The tip-lock shoe therefore provides a convenient means for controlling aligned movement of the window sash within the window frame, and at the same time, a reliable pivot point for periodic cleaning and maintenance. Tip-lock shoes of the kind described above are disclosed and described in the following U.S. Pat. Nos.: 3,055,063; 3,184,784; 3,197,819; 3,434,236; 3,434,237; 3,464,157; 3,482,354; 3,611,636; 3,789,549; 3,797,168; 3,844,066; 3,861,082; 4,028,849; 4,068,406; 4,079,549; 4,115,973; 4,364,199; 4,452,012; 4,590,708; 4,683,675; 4,683,676; and 4,718,194. The tip-lock shoes described in the foregoing patent references are of the widest possible variety in mechanical composition. Although each is characterized by the tip-lock feature described above, none discloses an independently operable trigger or mechanism for locking the shoe in position in the track automatically responsive to a catastrophic failure of the counterbalance system. Moreover, none of the tip-lock shoes disclosed in such references are inherently capable of automatically locking the shoe into a fixed position upon catastrophic failure of the counterbalance system.

The fail-safe tip-lock shoe disclosed herein is the first such tip-lock shoe capable of automatically preventing accidental movement of a window sash or the like upon catastrophic failure of a counterbalance system. Moreover, the fail-safe braking mechanism can be embodied without substantially increasing the dimensions of an otherwise typical tip-lock shoe, and without impairing the tilt-and-lock feature for which tip-lock shoes are named.

SUMMARY OF THE INVENTION

It is an object of this invention to provide a fail-safe mechanism to prevent accidental movement of doors, windows, panels and the like upon catastrophic failure of a counterbalance system for such doors, windows, panels and the like.

It is another object of this invention to provide a tip-lock shoe for window sashes and the like which incorporates a fail-safe braking mechanism for preventing accidental movement of window sashes and the like upon catastrophic failure of a counterbalance system for such window sashes and the like.

It is still another object of this invention to provide such a fail-safe mechanism as an integral, operational part of a tip-lock shoe for window sashes and the like.

It is yet another object of this invention to provide a tip-lock shoe with a fail-safe braking mechanism which operates independently of the tilt-lock braking mechanism.

These and other objects of this invention are accomplished by a tip-lock shoe for a window sash and the like, comprising: a hollow body adapted to slidably travel in a track; first means disposed in the body and movable between a retracted position enabling the body to slide freely in the track and an extended position for engaging the track and preventing movement of the body; second means disposed in the body for engaging the window sash and for urging the first means from the retracted position to the extended position responsive to tilting of the window sash and the like; and, third means disposed in the body for engaging a counterbalance system for supporting the body in the track and for urging the track engaging means from the retracted position to the extended position independently of the second means and automatically responsive to a loss of counterbalance force, whereby the window sash and the like can be slidably and tiltably operated in a normal fashion when the counterbalance system is operating properly, but the window sash and the like is prevented from accidental movement upon catastrophic failure of the counterbalance system.

In the presently preferred embodiment, the first means may comprise a wedge-shaped member having a first working surface for engaging the track, a second working surface for engaging the second means and a third working surface for at least indirectly engaging the third means. The second means may comprise a rotatably mounted cam having a working surface for engaging the second working surface of the first means. The third means may comprise at least one slidable wedge-shaped member; a first working surface for engaging and supporting the body and track during normal operation; a second working surface for engaging the first means upon catastrophic failure of the counterbalance system; and, resilient means for interconnecting the counterbalance system and the at least one slidable wedge-shaped member and for urging the third means from the body engaging position to the first means engaging position, the resilient means exerting a predetermined force smaller in magnitude than the counterbalance force to enable normal operation when the counterbalance system is operating properly, but sufficient in magnitude to reliably lock the first means into the extended position upon catastrophic failure of the counterbalance system.

These and other objects of the invention are also accomplished by an improved tip-lock shoe for a track-mounted window sash and the like supported by a counterbalance system, the tip-lock shoe having a locking member for preventing movement of the sash in the track when the sash is tilted away from the track, the locking member being moved into a locking position responsive to movement of a sash receiving member to which a sash is detachably connectable, the improvement comprising: means disposed in the shoe for engaging the counterbalance system for supporting the shoe in the track and for urging the locking member into the locking position and independently of the sash receiving member and automatically responsive to a loss of counterbalance force, whereby the sash can be slidably and tiltably operated in normal fashion as long as the counterbalance system is operating properly, but the sash is prevented from accidental movement upon catastrophic failure of the counterbalance system.

In a presently preferred embodiment, the supporting and urging means comprises: at least one slidable wedge-shaped member having a first working surface for engaging and supporting the shoe in the track during normal operation and a second working surface for at least indirectly engaging the locking member upon failure of the counterbalance system; and, resilient means for interconnecting the counterbalance system and the slidable wedge-shaped member and for urging the wedge-shaped member from the shoe engaging position to the locking member engaging position, the resilient means exerting a predetermined force smaller in magnitude than the counterbalance force to enable normal operation when the counterbalance system is operating properly, but sufficient in magnitude to reliably move the locking member into the locking position, and thereafter hold the locking member in the locking position, upon catastrophic failure of the counterbalance system. The supporting and urging means may further comprise a member mounted for movement between a shoe supporting position and a shoe locking position, the member having two arms extending on opposite sides of the sash receiving member; and, a force transmission member disposed between the distal ends of the arm and the locking member.

Other objects and advantages of the invention will be apparent to those skilled in the art upon consideration of the following detailed description of the presently preferred embodiments of the invention and the accompanying drawings.

BRIEF DESCRIPTION OF THE DRAWINGS

A fail-safe tip-lock shoe according to the presently preferred embodiment of this invention is shown in the following drawings, it being understood, however, that the invention is not limited to the precise arrangements and instrumentality shown.

DETAILED DESCRIPTION OF THE PREFERRED EMBODIMENTS

Figure 1:
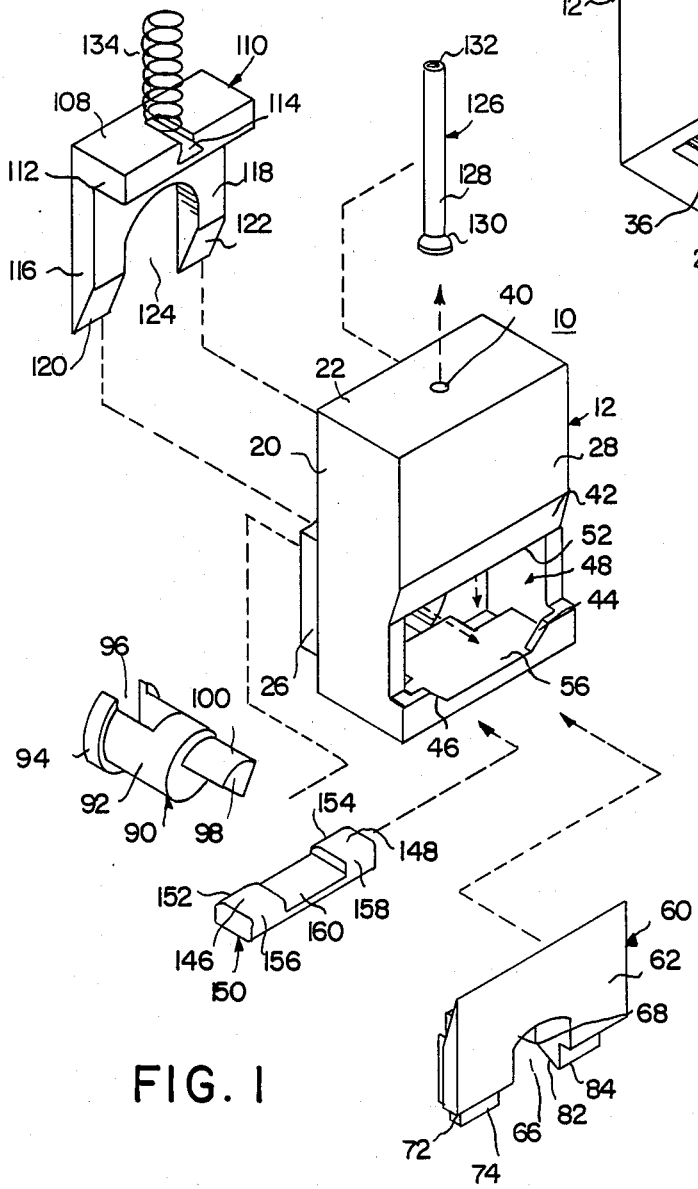
FIG. 1 is an exploded view of a fail-safe tip-lock shoe according to this invention.

A fail-safe tip-lock shoe is shown in the drawings and generally designated by reference numeral 10. The tip-lock shoe 10 comprises a hollow body or block 12 supported by a sash cord or cable 14 which is itself connected to a counterbalance system for a window sash or the like. The counterbalance system itself does not form a part of the invention, and is not shown in the drawings. The tip-lock shoe 10 is adapted to be slidably mounted in a channel formed by a track 8, partially illustrated in FIGS. 3, 4 and 5. A window sash is typically supported by two such shoes 10, running in respective vertically oriented tracks 8 disposed on opposite sides of a window frame. During normal operation, the shoes 10 are supported in the tracks by cords or cables 14, and in turn support an openable window sash in the window frame.

Figure 2:
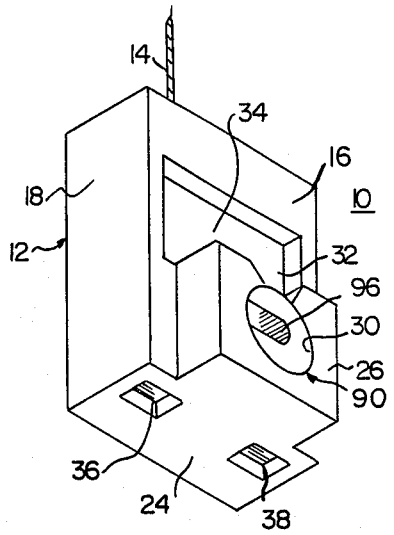
FIG. 2 is a perspective view of the fail-safe tip-lock shoe shown in FIG. 1

With particular reference to FIGS. 1 and 2, the hollow body 12 comprises a front wall 16, a left wall 18, a right wall 20, a top wall 22, a bottom wall 24 and a rear wall 28. A boss 26 projects outwardly from the lower part of front wall 16. Boss 26 defines a bore 30 for receiving rotatable cam member 90. Cam 90 is provided with a slot 96, which in one rotational position is in alignment with and opens into notch 32. Front wall 16 is also provided with an opening 34. Bottom wall 24 is provided with two rectangular openings 36 and 38. Top wall 22 is provided with a bore 40 and a cylindrical cavity 50 (See FIGS. 3, 4 and 5) in communication with one another. Cylindrical cavity 50 is of a larger diameter than bore 40. Rear wall 28 is provided with an opening 48, bounded on either side by side walls 18 and 20, on the bottom by the floor or inside surface 56 of bottom 24 and by the lower edge 52 of wedge-shaped portion 42.

Figure 3:
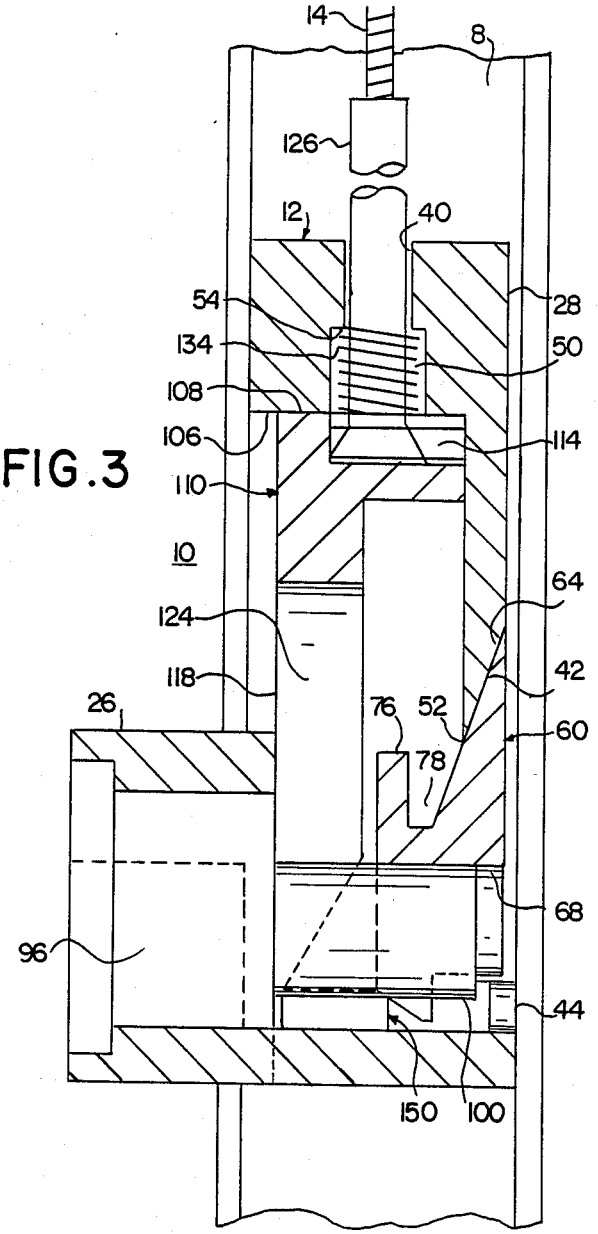
FIG. 3 is a section view, in side elevation, of the tip-lock shoe shown in FIGS. 1 and 2 in an unlocked, freely slidable condition.
Figure 5:
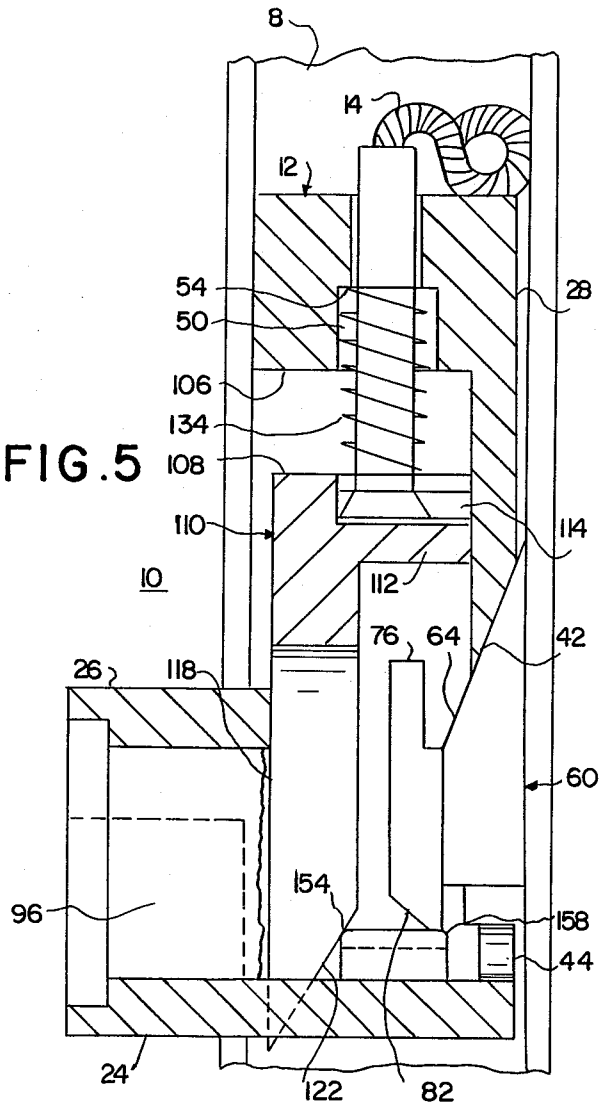
Figure 4:
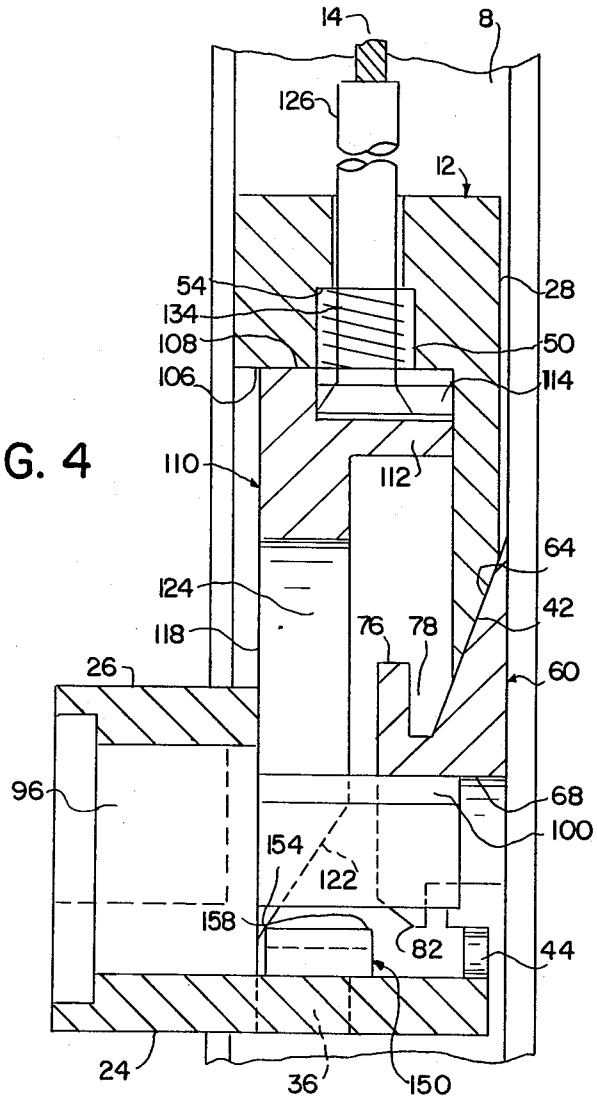
FIG. 4 is a section view in side elevation, similar to FIG. 3, but wherein the tip-lock shoe is in a locked condition responsive to tilting of a window sash and the like; and, FIG. 5 is a section view in side elevation, similar to FIG. 3, but wherein the tip-lock cam is partially cutaway and the tip-lock shoe is in a locked condition responsive to catastrophic failure of the counterbalance system.

With further reference to FIG. 3, a locking member 60 is disposed in the body 10 and is movable between a retracted position enabling the body to slide freely in the track 8, as shown in FIG. 3, and an extended position for engaging the track 8 and preventing movement of the body in the track 8, as shown in FIGS. 4 and 5. The locking member 60 comprises a plurality of working surfaces. Working surface 62 is adapted to engage a wall of track 8, for locking the shoe into a fixed position in the track. Wedge-shaped surface 64 is adapted to engage wedge-shaped portion 42 of rear wall 28. A notch or opening 66 is bounded by a curved working surface 68. Downwardly depending legs 70 and 80 are provided with wedge-shaped working surfaces 72 and 82 respectively. Legs 70 and 80 are also provided with outwardly facing surfaces 74 and 84. An upstanding rib 76 defines a notch 78.

The retracted position of locking member 60 is illustrated in FIG. 3. The extended position of locking member 60, for engaging the track 8 and preventing movement of the body in the track, is shown in FIGS. 4 and 5. With respect to the orientation of FIGS. 3, 4 and 5, the extended position is to the right and higher than the retracted position. Upward movement of locking member 60 causes a sliding engagement of wedge-shaped surfaces 42 and 64, which forces locking member 60 to the right, as it moves upwardly. Locking member 60 may be forced upwardly, and to the right (outwardly, with respect the hollow body 10 and rear wall 28) responsive to either one of two lock activating members.

A first lock activating member 90 is in the form of a rotatable cam, which is disposed in bore 30 of boss 26. First lock activating member 90 comprises a cylindrical body 92 an annular flange 94 and a projecting cam portion 98. Projecting cam portion 98 is provided with a cam surface 100. Cylindrical portion 92 and flange 94 have a slot 96 formed therein, for receiving a corresponding lug which forms an interconnection between the tip-lock shoe 10 and an openable window sash or the like. The lug is insertable into notch 96 through notch 32. Thereafter, inwardly and outwardly tilting movements of the window sash effect rotation of the first lock activating member 90 within bore 30. In the unlocked condition shown in FIG. 3, cam surface 100 is out of contact with cam surface 68 of locking member 60. When an openable window sash is tilted out of its track, first lock activating member 90 is rotated so as to bring cam surface 100 into engagement with cam surface 68, as shown in FIG. 4. Engagement of cam surface 100 and cam surface 68 causes the locking member 60 to be forced upwardly. As the locking member is forced upwardly, engagement of wedge-shaped working surfaces 42 and 64 force the locking member outwardly, to the right, so that surface 62 engages track 8. The hollow body is thereby locked into position in track 8, so that the tip-lock shoe provides a safe and stable pivot point for the outwardly tilted window sash. When the window sash is tilted back into its normal operating position, first lock activating member 90 is rotated back into its initial position, so that cam surface 100 is no longer pressing upwardly against and engaging cam surface 68. Accordingly, lock member 60 is therefore free to fall downwardly and inwardly, back within the confines of the exterior boundaries of hollow body 12. The window sash is then free to be moved upwardly and downwardly as desired.

A tip-lock shoe 10 according to this invention is provided with an auxiliary trigger or mechanism for moving the locking member 60 from the retracted position to the extended position independently of the first lock activating member 90 and automatically responsive to a loss of counterbalance force, for example, if the sash cord or cable 14 snaps. Such failure might also include failures in other parts of the counterbalance structure, for example pulleys, brackets, springs or the like.

The auxiliary trigger or mechanism comprises a second lock activating member 110 and a force transmission member 150. Second lock activating member 110 has an inverted L-shape in side elevation. A base 112 is provided with an upwardly opening slot 114 of substantially triangular cross-section. Groove 114 opens onto the edge of the distal end of base 112, as shown most clearly in FIG. 1. Two legs, 116 and 118 are defined by a substantially semi-circular notch 124, and project downwardly from base 112. The distal ends of legs 116 and 118 are provided with wedge-shaped working surfaces 120 and 122 respectively. Legs 116 and 118 are adapted to extend downwardly on opposite sides of first lock activating member 90.

The second lock activating member 110 is mounted for slidable movement between a tip-lock shoe supporting position, as shown in FIG. 3, and a tip-lock shoe locking position, as shown in FIG. 5. As shown in FIG. 5, the ends of legs 116 and 118 extend into and through openings 36 and 38, in the bottom wall of hollow body 12, when the second lock activating member is in the shoe locking position. This provides sufficient travel for the second lock activating member without having to substantially increase the size of the tip-lock shoe 10, as compared to a conventional tip-lock shoe.

The force transmission member 150 rests on the inside surface or floor 56 of bottom wall 24. A notch 160 defines two upward projections 146 and 148. Projection 146 is provided with two rounded working surfaces 152 and 156. Projection 148 is provided with two curved working surfaces 154 and 158. Notch 160 accommodates first lock activating member 90, and serves to keep the force transmission member properly positioned. The force transmission member 150 is operatively disposed between the second lock activating member 110 and the locking member 60. More particularly, wedge-shaped working surfaces 120 and 122 are adapted to engage curved working surfaces 152 and 154 respectively. Curved working surfaces 156 and 158 are adapted to operatively engage wedge-shaped working surfaces 72 and 82 respectively. As shown in FIG. 5, the upper surface 108 of base 112 engages the inner surface 106 of upper wall 22 of hollow body 12 in the shoe supporting position. When second lock activating member 110 moves downwardly into the shoe locking position, interengagement of working surfaces 120, 152 and 122, 154 pushes the force transmission member 150 to the right (in the sense of FIG. 5). Engagement of working surfaces 156, 72 and 158, 82 forces the locking member upwardly. As the locking member 60 is moved upwardly, engagement of working surfaces 42 and 64 moves locking member 60 outwardly as well, to engage the track 8 and lock the shoe 10 into position.

Triangular shaped wall sections 44 and 46 prevent the force transmission member 150 and the bottom of locking member 60 from falling out of the hollow body 12 when the hollow body is not disposed in the channel of track 8. Upstanding rib 76 prevents the upper part of locking member 60 from falling out of opening 48 under the same circumstances. Notch 78 provides clearance for the lower edge 52 of surface 42.

The second lock activating member 110 includes means for engaging the counterbalance system for supporting the body and the track and for urging the second lock activating member 110 from the shoe supporting position to the locking position independently of the first lock activating member and automatically responsive to a loss of counterbalance force, upon catastrophic failure of the counter balance system. Accordingly, the counterbalance system is not directly connected to the hollow body 12, but is connected indirectly to the hollow body 12 and directly to the second lock activating member 110. More particularly, a pin 126 has and at least partially hollow body or barrel section 128 with a flange 130 at one end thereof and an opening 132 at the end thereof opposite the flange 130. Pin 126 is adapted to freely slidably pass through bore 50 and bore 40 in top wall 22, from the interior of hollow body 12 to the exterior thereof. Resilient means in the form of spring 134 fits over pin 126, and in the shoe engaging position, fits substantially entirely in cylindrical cavity 50. The flange 130 is adapted to be slidably received in groove 114, whereby spring 134 is kept in compression between the upper surface 108 of base 112 and the annular surface 54 formed at the top of cylindrical cavity 50, at the intersection of cavity 50 and bore 40. The end of sash cord or cable 14 may be slipped into the opening 132 of pin 126, and held in place, for example by crimping or the like.

As long as the counterbalance force continues to be exerted, second lock activating member 110 will be held in firm engagement with the inner surface 106 of top wall 22, and the second lock activating member will remain in the shoe supporting position. Upon catastrophic failure of the counterbalance system, for example a broken sash cord or cable as shown in FIG. 5, the spring 134 will axially expand, urging the second lock activating member 110 downwardly, into the shoe locking position. Downward movement of the second lock activating member 110 effects movement of the force transmission member 150, which in turn effects movement of the locking member 60. Even when this auxiliary locking mechanism has been activated to prevent accidental movement of the window sash, the window sash may still be intentionally tilted out and removed to facilitate repairs.

It will be appreciated that the spring 134 should exert a predetermined force smaller in magnitude than the counterbalance force to enable normal operation when the counterbalance system is operating properly, but sufficient in magnitude to reliably move the locking member into the locking position, and thereafter hold the locking member in the locking position, when the counterbalance system fails. The amount of the predetermined force will depend upon the size and weight of the window sash, as well as the magnitude of the force exerted by the counterbalance system.

All of the parts of a fail-safe tip-lock shoe 10 according to this invention may be manufactured from a variety of rigid plastic materials such as injection molded polymers, for example nylon, except of course for pin 126 and spring 134. The plastic materials should exhibit a coefficient of sliding friction which will enable easy movement of the shoe in the track, as well as easy engagement of the lock activating mechanisms.

The invention may be embodied in other specific forms without departing from the spirit or essential attributes thereof. Accordingly, reference should be made to the appended claims, rather than to the foregoing specification, as indicating the true scope of the invention.

What is claimed is:

1. A tip-lock shoe for a window sash and the like, comprising:

a hollow body adapted to slidably travel in a track;

first means disposed in the body and movable between a retracted position enabling the body to slide freely in the track and an extended position for engaging the track and preventing movement of the body;

second means disposed in the body for engaging the window sash and for urging the first means from the retracted position to the extended position responsive to tilting of the window sash and the like; and, third means disposed in the body for engaging a counterbalance system for supporting the body in the track and for urging the track engaging means from the retracted position to the extended position independently of the second means and automatically responsive to a loss of counterbalance force, whereby the window sash and the like can be slidably and tiltably operated in normal fashion as long as the counterbalance system is operating properly but the window sash and the like is prevented from accidental movement upon catastrophic failure of the counterbalance system.

2. The tip-lock shoe of claim 1, wherein the first means has first and second working surfaces; the second means comprises a rotatably mounted cam having a working surface for engaging the first working surface of the first means; and, the third means comprises a slidable member and a working surface for at least indirectly engaging the second working surface of the first means.

3. The tip-lock shoe of claim 1, wherein the second means is mounted for rotation about a first axis and the third means is mounted for movement along a second axis substantially perpendicular to the first axis.

4. The tip-lock shoe of claim 1, wherein the third means comprises:

at least one slidable wedge-shaped member;

a first working surface for engaging and supporting the body in the track during normal operation;

a second working surface for engaging the first means upon failure of the counterbalance system; and, resilient means for interconnecting the counterbalance system and the at least one slidable wedge-shaped member and for urging the third means from the body engaging position to the first means engaging position, the resilient means exerting a predetermined force smaller in magnitude than the counterbalance force to enable normal operation when the counterbalance system is operating properly, but sufficient in magnitude to reliably lock the first means into the extended position when the counterbalance system fails.

5. The tip-lock shoe of claim 4, wherein the wedge-shaped member comprises two arms, extending on opposite sides of the second means, the second working surface of the wedge-shaped member being formed in two parts, one part on the distal end of each of the arms.

6. The tip-lock shoe of claim 1, wherein the first means comprises a wedge-shaped member having a first working surface for engaging the track, a second working surface for engaging the second means and a third working surface for at least indirectly engaging the third means.

7. The tip-lock shoe of claim 6, wherein the second means comprises a rotatably mounted cam having a working surface for engaging the second working surface of the first means; and, the third means comprises a slidable wedge-shaped member and a working surface for engaging the third working surface of the first means.

8. The tip-lock shoe of claim 7, wherein the third means further comprises:

the slidable wedge-shaped member having a first working surface for engaging and supporting the body in the track during normal operation and a second working surface for at least indirectly engaging the first means upon failure of the counterbalance system; and, resilient means for interconnecting the counterbalance system and the slidable wedge-shaped member and for urging the third means from the body engaging position to the first means engaging position, the resilient means exerting a predetermined force smaller in magnitude than the counterbalance force to enable normal operation when the counterbalance system is operating properly, but sufficient in magnitude to reliably lock the first means into the extended position when the counterbalance system fails.

9. The tip-lock shoe of claim 8, wherein the third means comprises a force transmission member operatively disposed between the second working surface of the wedge-shaped member and the third working surface of the first means.

10. An improved tip-lock shoe for a track-mounted sash supported by a counterbalance system, the tip-lock shoe having a locking member for preventing movement of the sash in the track when the sash is tilted away from the track, the locking member being moved into a locking position responsive to movement of a sash receiving member to which a sash is detachably connectable, the improvement comprising:

means disposed in the shoe for engaging the counterbalance system for supporting the shoe in the track and for urging the locking member into the locking position independently of the sash receiving member and automatically responsive to a loss of counterbalance force, whereby the sash can be slidably and tiltably operated in normal fashion as long as the counterbalance system is operating properly but the sash is prevented from accidental movement when upon catastrophic failure of the counterbalance system.

11. The improved tip-lock shoe of claim 10, wherein the supporting and urging means comprises:

a slidable wedge-shaped member having a first working surface for engaging and supporting the shoe in the track during normal operation and a second working surface for at least indirectly engaging the locking member upon failure of the counterbalance system; and, resilient means for interconnecting the counterbalance system and the slidable wedge-shaped member and for urging the wedge-shaped member from the shoe engaging position to the locking member engaging position, the resilient means exerting a predetermined force smaller in magnitude than the counterbalance force to enable normal operation when the counterbalance system is operating properly, but sufficient in magnitude to reliably move the locking member into the locking position, and thereafter hold the locking member in the locking position, when the counterbalance system fails.

12. The improved tip-lock shoe of claim 10, wherein the supporting and urging means comprises a member mounted for movement between a shoe supporting position and a shoe locking position.

13. The improved tip-lock shoe of claim 12, wherein the sash receiving member is mounted for rotation about a first axis, and the member of the supporting and urging means is mounted for movement along a second axis substantially perpendicular to the first axis.

14. The improved tip-lock shoe of claim 13, wherein the member of the supporting and urging means comprises two arms extending on opposite sides of the sash receiving member and further comprising a force transmission member disposed between the distal ends of the arms and the locking member.

15. A tip-lock shoe for a window sash and the like, comprising:

a hollow block adapted to slidably travel in a track;

a locking member disposed in the block and movable between a retracted position enabling the block to slide freely in the track and an extended position for engaging the track and preventing movement of the block;

a first lock activating member disposed in the block for engaging the window sash and for urging the locking member from the retracted position to the extended position responsive to tilting of the window sash and the like; and, a second lock activating member disposed in the block for engaging a counterbalance system for supporting the block in the track and for urging the locking member from the retracted position to the extended position independently of the first lock activating member and automatically responsive to a loss of counterbalance force, whereby the window sash and the like can be slidably and tiltably operated in normal fashion as long as the counterbalance system is operating properly but the window sash and the like is prevented from accidental movement upon catastrophic failure of the counterbalance system.

16. The tip-lock shoe of claim 15, further comprising a force transmission member operatively disposed between the second lock activating member and the locking member.

17. The tip-lock shoe of claim 16, wherein the second lock activating member is directly connectable to the counterbalance system and further comprising resilient means disposed between the second lock activating member and the block for urging the second lock activating member into engagement with the force transmission member responsive to a loss of counterbalance force.

18. The tip-lock shoe at claim 16, wherein the first lock activating member is disposed between the second lock activating member and the force transmission member, the second lock activating member having legs extending on opposite sides of the first lock activating member for engagement with the force transmission member.

19. The tip-lock shoe at claim 18, wherein the locking member comprises legs extending on opposite sides of the first lock activating member for engagement with the force transmission member, the legs defining an opening bounded in part by a surface for engagement with the first lock activating member.

20. The tip-lock shoe of claim 19, wherein the second lock activating member is directly connectable to the counterbalance system and further comprising resilient means disposed between the second lock activating member and the block for urging the second lock activating member into engagement with the force transmission member responsive to a loss of counterbalance force.

* * * * *